US010498091B2

(12) United States Patent
Xu et al.

(10) Patent No.: US 10,498,091 B2
(45) Date of Patent: *Dec. 3, 2019

(54) ELECTRICAL CONNECTOR WITH STACKED SHIELDING PLATES SANDWICHED BETWEEN TWO OPPOSITE CONTACT MODULES

(71) Applicant: FOXCONN INTERCONNECT TECHNOLOGY LIMITED, Grand Cayman (KY)

(72) Inventors: Yin-Chao Xu, Kunshan (CN); Wei Zhong, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 16/105,914

(22) Filed: Aug. 20, 2018

(65) Prior Publication Data

US 2019/0058292 A1 Feb. 21, 2019

(30) Foreign Application Priority Data

Aug. 18, 2017 (CN) ..... 2017 2 1042371 U

(51) Int. Cl.
*H01R 13/648* (2006.01)
*H01R 13/6597* (2011.01)
(Continued)

(52) U.S. Cl.
CPC ..... *H01R 13/6597* (2013.01); *H01R 13/6585* (2013.01); *H01R 13/405* (2013.01); *H01R 13/504* (2013.01); *H01R 24/60* (2013.01)

(58) Field of Classification Search
CPC ..... H01R 13/6597; H01R 13/6585; H01R 13/405; H01R 13/504; H01R 24/60; H01R 2107/00
(Continued)

(56) References Cited

U.S. PATENT DOCUMENTS 2,472,747 A * 6/1949 Jones ..... H05K 9/002 174/378
4,440,463 A * 4/1984 Gliha, Jr. ..... H01R 13/6582 439/92
(Continued)

FOREIGN PATENT DOCUMENTS

CN 204947168 U 1/2016

*Primary Examiner* — Abdullah A Riyami
*Assistant Examiner* — Vladimir Imas
(74) *Attorney, Agent, or Firm* — Wei Te Chung; Ming Chieh Chang

(57) ABSTRACT

A high frequency electrical connector includes a housing with first and second rows of contacts therein. The housing includes a base and a mating tongue extending forwardly from the base. Each contacts has a contacting section exposed upon the mating surface of the mating tongue, a connection section exposed out of the base, and a middle section therebetween. The first row of contacts as well as the second row of contacts includes a plurality of grounding contacts. First and second shielding plates stacked with each other and commonly between the first row of contacts and the second row of contacts. The first shielding plate has two rows of spring tangs in pairs wherein each pair of spring tangs commonly contact the same grounding contact.

20 Claims, 7 Drawing Sheets

(51) Int. Cl.
*H01R 13/6585* (2011.01)
*H01R 13/504* (2006.01)
*H01R 13/405* (2006.01)
*H01R 24/60* (2011.01)

(58) Field of Classification Search
USPC ..... 439/607.05
See application file for complete search history.

(56) References Cited

U.S. PATENT DOCUMENTS 5,257,949 A * 11/1993 Paulus ..... H01R 13/7197 333/185
7,828,597 B1 * 11/2010 Jin ..... H01R 13/6471 439/607.05
8,337,249 B2 * 12/2012 Lappoehn ..... H01R 13/6585 439/607.55
8,808,029 B2 * 8/2014 Castillo ..... H01R 13/6585 439/607.05
9,178,319 B2 * 11/2015 Little ..... H01R 13/6585
9,281,626 B2 * 3/2016 Lin ..... H01R 13/6581
9,281,643 B1 * 3/2016 Tseng ..... H01R 13/518
9,306,336 B2 * 4/2016 Chang ..... H01R 13/6471
9,401,570 B2 * 7/2016 Phillips ..... H01R 13/6585
9,461,378 B1 * 10/2016 Chen ..... H01R 12/707
9,461,412 B2 * 10/2016 Yu ..... H01R 13/6585
9,461,415 B2 * 10/2016 Guo ..... H01R 13/41
9,520,683 B2 * 12/2016 Qian ..... H01R 13/6585
9,525,241 B1 * 12/2016 Su ..... H01R 13/6581
9,564,716 B2 * 2/2017 Kao ..... H01R 13/6586
9,640,923 B2 * 5/2017 Kao ..... H01R 12/724
9,653,849 B2 * 5/2017 Hsu ..... H01R 13/6585
9,673,569 B2 * 6/2017 Zhang ..... H01R 13/6585
9,685,751 B2 * 6/2017 Yu ..... H01R 13/405
9,722,369 B1 * 8/2017 Hsu ..... H01R 24/60
9,728,899 B2 * 8/2017 Peng ..... H01R 13/6581
9,735,512 B2 * 8/2017 Hsu ..... H01R 13/6596
9,780,496 B2 * 10/2017 Guo ..... H01R 13/405
9,799,999 B1 * 10/2017 Tsai ..... H01R 12/57
9,853,399 B2 * 12/2017 Kao ..... H01R 13/6585
9,929,513 B2 * 3/2018 Wang ..... H01R 13/6591
9,972,945 B1 * 5/2018 Huang ..... H01R 13/6585
9,997,871 B2 * 6/2018 Zhong ..... H01R 24/28
10,027,063 B2 * 7/2018 Peng ..... H01R 12/594
10,027,066 B2 * 7/2018 Zhong ..... H01R 13/6597
10,038,286 B2 * 7/2018 Zhu ..... H01R 13/6585
10,044,148 B2 * 8/2018 Zhao ..... H01R 13/6581
10,050,373 B2 * 8/2018 Wang ..... H01R 13/5219
10,063,014 B2 * 8/2018 Wen ..... H01R 13/04
10,135,197 B2 * 11/2018 Little ..... H01R 12/58
10,141,693 B2 * 11/2018 Zhao ..... H01R 13/405
10,199,775 B2 * 2/2019 Zhao ..... H01R 13/6585
10,199,777 B2 * 2/2019 Zhao ..... H01R 13/6585
10,211,554 B2 * 2/2019 Zhou ..... H01R 12/716
10,211,563 B2 * 2/2019 Zhao ..... H01R 12/724
10,236,632 B2 * 3/2019 Zhang ..... H01R 13/50
2002/0061669 A1 * 5/2002 Yu ..... H01R 13/6582 439/95
2014/0024257 A1 * 1/2014 Castillo ..... H01R 13/6585 439/607.05
2016/0064866 A1 * 3/2016 Kao ..... H01R 13/6471 439/676
2016/0352050 A1 * 12/2016 Hu ..... H01R 13/6597
2018/0166830 A1 * 6/2018 Feng ..... H01R 13/6593

* cited by examiner

ELECTRICAL CONNECTOR WITH STACKED SHIELDING PLATES SANDWICHED BETWEEN TWO OPPOSITE CONTACT MODULES

BACKGROUND OF THE INVENTION

1. Field of the Invention

The present invention relates to a high frequency electrical connector, and particularly to the electrical connector with stacked shielding plates sandwiched between a pair of contact modules wherein each shielding plate includes at least one spring tang mechanically and electrically connecting to one grounding contact. This instant application relates to a copending application with the same applicant, the same filing date and the same title thereof.

2. Description of Related Art

Using a spring tang punched out of a metallic plate to contact a grounding contact for enhancing grounding effect, is essentially a popular method. Anyhow, when such a metallic plate is shared by multiple items thereabouts, it is relatively difficult to provide sufficient grounding structures in the limited space thereabouts.

It is desired to have an electrical connector with sufficient metallic structures to provide sufficient shielding and/or grounding effect thereabouts.

SUMMARY OF THE INVENTION

An object of the invention is to provide a high frequency electrical connector with a housing with first and second rows of contacts therein. The housing includes a base and a mating tongue extending forwardly from the base. Each contacts has a contacting section exposed upon the mating surface of the mating tongue, a connection section exposed out of the base, and a middle section therebetween. The first row of contacts as well as the second row of contacts includes a plurality of grounding contacts. First and second shielding plates stacked with each other and commonly between the first row of contacts and the second row of contacts. The first shielding plate has two rows of spring tangs in pairs wherein each pair of spring tangs commonly contact the same grounding contact.

Another embodiment of the invention is to provide the shielding plate with only one spring tang with regard to the same grounding contact while the spring tang of the first shielding plate with regard to the corresponding grounding contact of the first row of contacts is essentially offset from the spring tang of the second shielding plate with regard to the corresponding grounding contact of the second row of contacts in a top view so as to assure the superior shielding effect in the vertical direction, compared with the single layer shielding plate arrangement.

Other objects, advantages and novel features of the invention will become more apparent from the following detailed description when taken in conjunction with the accompanying drawings.

DETAILED DESCRIPTION OF THE PREFERRED EMBODIMENT

Figure 1:
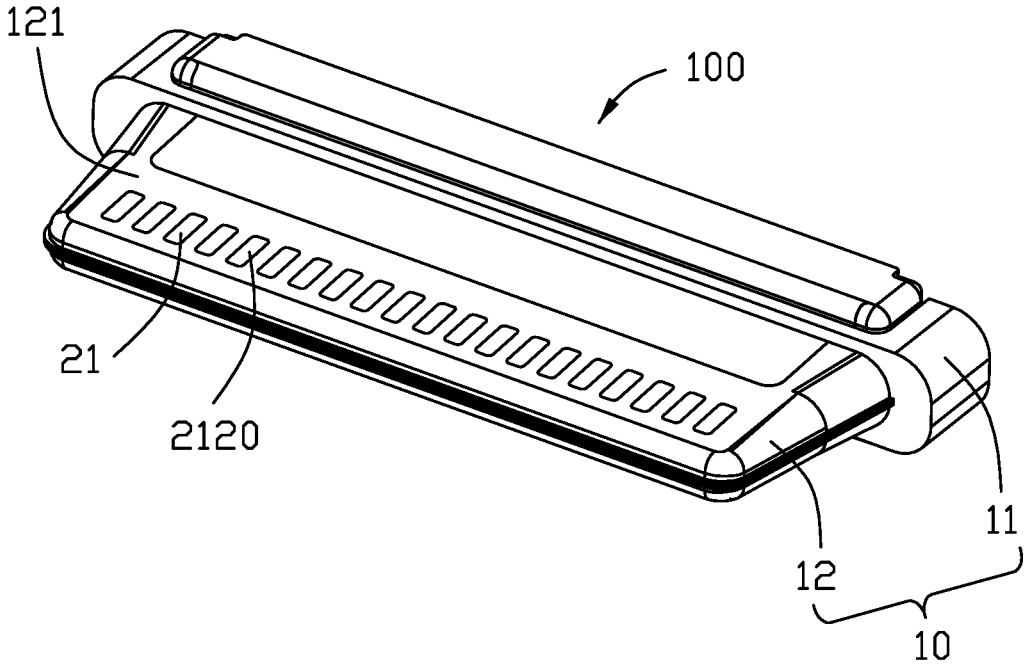
FIG. 1 is a perspective view of an electrical connector according to the invention.
Figure 2:
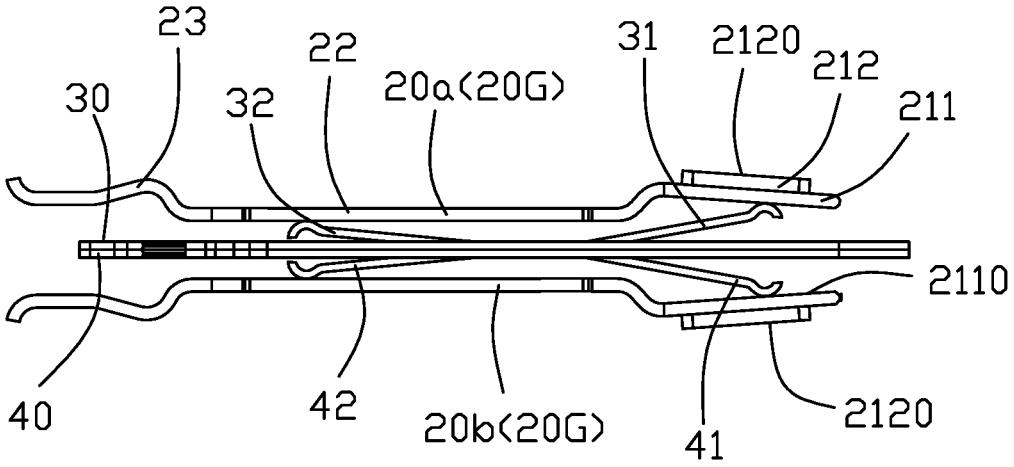
FIG. 2 is a side view of the shielding plates and the corresponding contacts of the electrical connector of FIG. 1.
Figure 3:
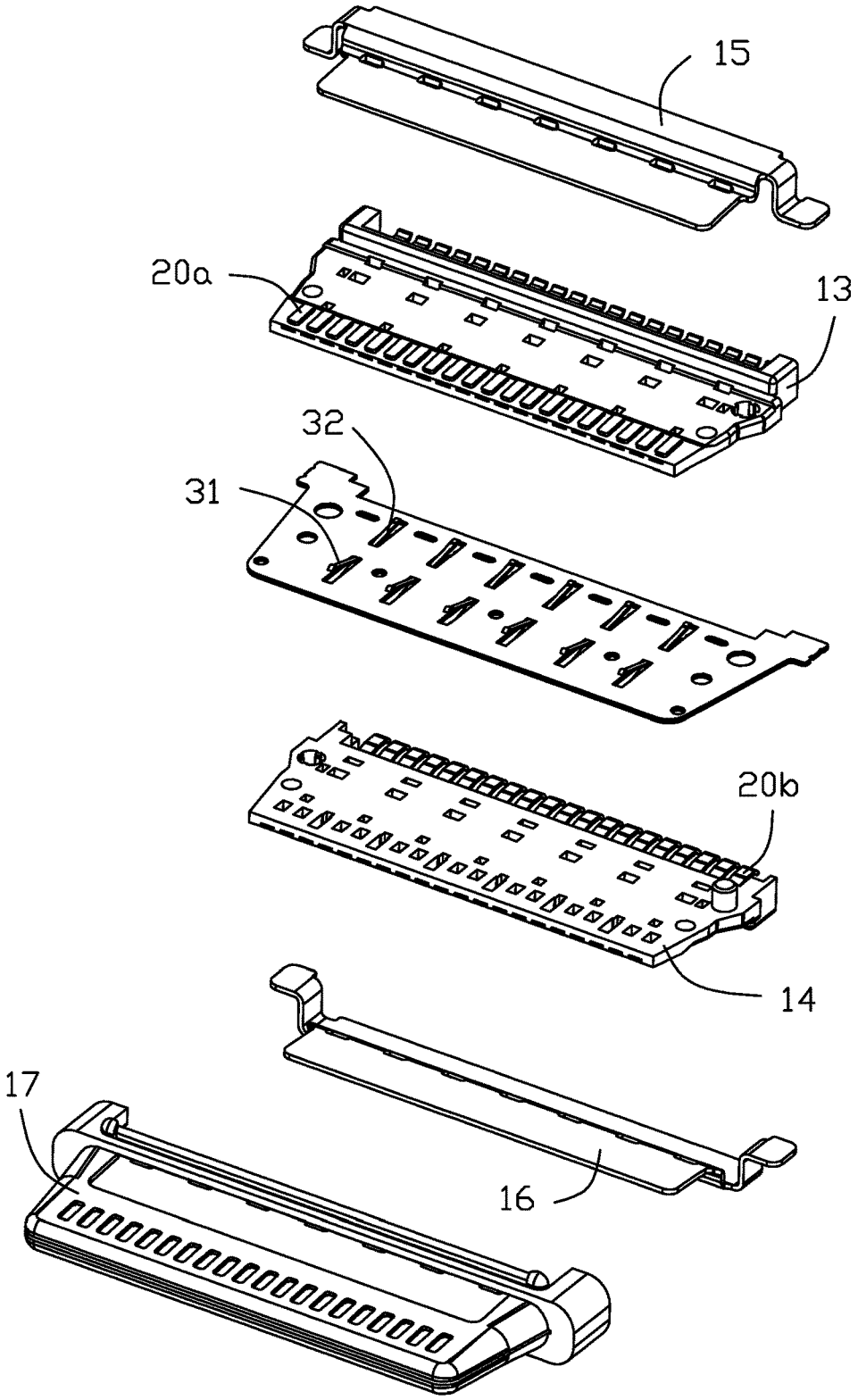
FIG. 3 is an exploded perspective view of the electrical connector of FIG. 1.
Figure 4:
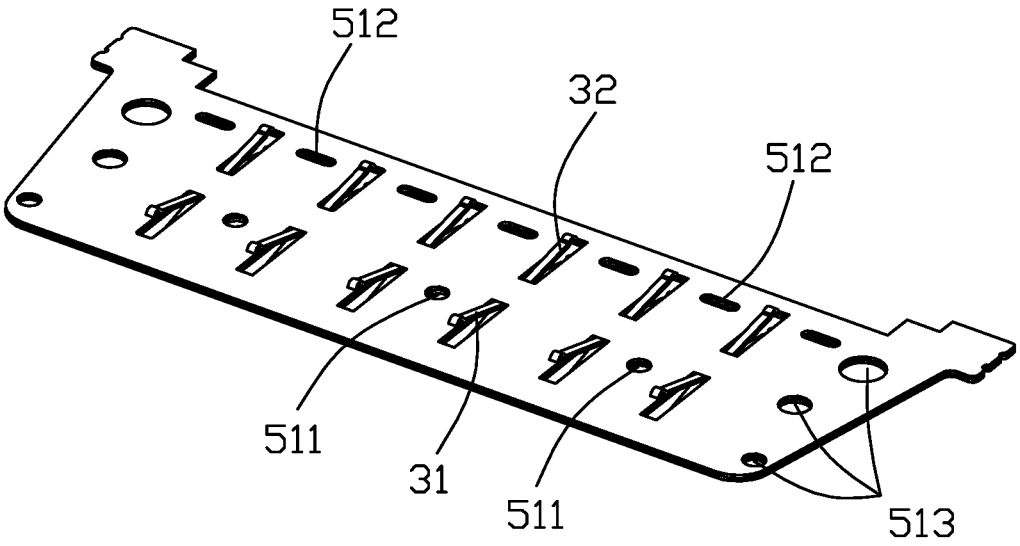
FIG. 4 is a perspective view of the stacked shielding plates of the electrical connector of FIG. 1.
Figure 5:
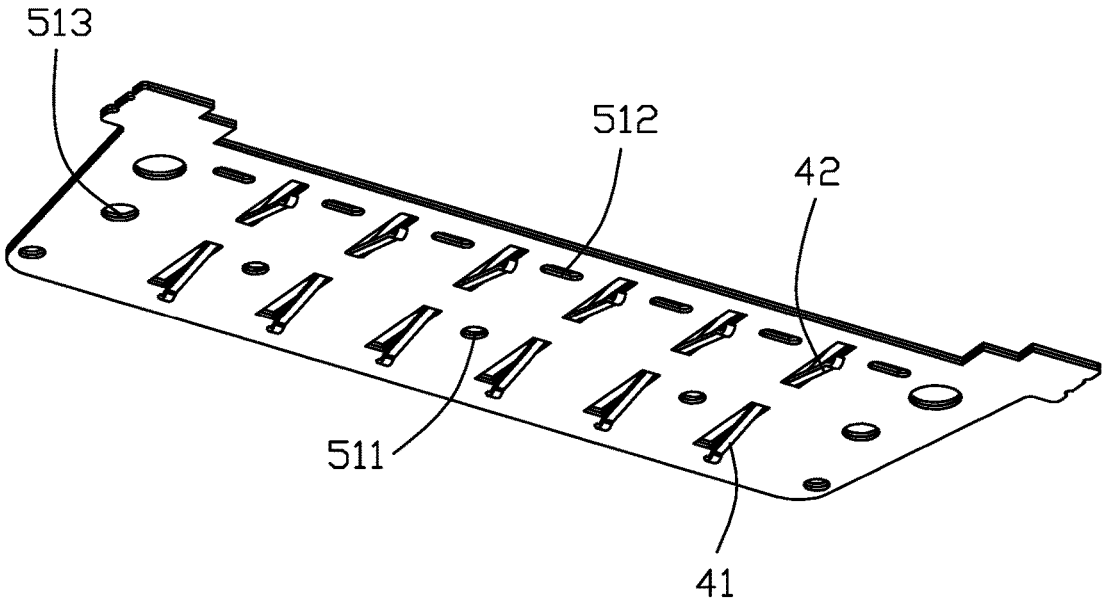
FIG. 5 is another perspective view of the stacked shielding plates of the electrical connector of FIG. 4.

Referring to FIGS. 1-5, the electrical connector 100 includes an insulative housing 10, a row of first contacts 20*a* and a row of second contacts 20*b* both arranged along the transverse direction, and a first metallic shielding plate 30 and a second metallic shielding plate 40 stacked with each other and commonly located between the first row of contacts 20*a* and the second row of contacts 20*b* in the vertical direction. In this embodiment, the first contacts 20*a* and the second contacts 20*b* are same with each other while arranged in an opposite mirror image manner. Similarly the first shielding plate 30 and the second shielding plate 40 are same with each other while arranged in an opposite mirror image manner. The housing 10 includes a base 11 and a mating tongue 12 extending forwardly from the base 11 and having opposite mating surfaces 121. Each of the first contacts 20*a* and second contacts 20*b* includes a front contacting section 21 exposed upon the mating surface 121, a rear connecting section 23 exposed out of the base 11, and an intermediate section 22 therebetween along the front-to-back direction. The first contacts 20*a* and the second contacts 20*b* both having corresponding grounding contact 20G. The first shielding plate 30 has the first spring tangs 31 in a first row and the second spring tangs 32 in a second row spaced from each other in the front-to-back direction wherein the first spring tangs 31 and the second spring tangs are paired respectively so as to have each paired first spring tang 31 and second spring tang 32 commonly contact the two different positions of the same grounding contact 20G of the first contacts 20*a*. Similarly, the second shielding plate 40 has the first spring tangs 41 in a first row and the second spring tangs 42 in a second row space from each other in the front-to-back direction wherein the first spring tangs 41 and the second sprint tangs 42 are paired respectively so as to have each paired first spring tang 41 and second spring tang 42 commonly contact a same grounding contact 20G at two spaced positions in the front-to-back direction. In this embodiment, the first spring tangs 31 of the first shielding plate 30 and the first spring tangs 41 of the second shielding plate 40 are respectively aligned with each other in the vertical direction, and the second spring tangs 32 and 42 are as well.

The contacting section 21 includes an extension 211 and a protrusion 212 upon the extension 211 with a top face 2120 exposed upon the corresponding mating surface 121. The first spring tang 31 extends forwardly toward the first contact 20*a* to abut against the undersurface 2110 of the extension 211 at one point while the second spring tang 32 extends rearwardly toward the first contact 20*b* to contact a rear portion of the intermediate section 22 adjacent to the connecting section 23 at another point. Similarly, the first spring tang 41 extends forwardly toward the second contact 20*b* to abut against the undersurface 2110 of the extension 211 at one point while the second spring tang 32 extends rearwardly toward the second contact 20*b* to contact a rear portion of the intermediate section 22 adjacent to the connecting section 23 at another point. Notably, the contacting section 21 and the connecting section 23 experience the relatively significant impedance change requiring addition shielding/grounding support thereabouts. The invention satisfies this requirement.

The first shielding plate 30 and the second shielding plate 40 are fastened to each other via either soldering or welding or other ways. A plurality of round holes 511 are alternately arranged with the first spring tangs 31 in the transverse direction, and a plurality of elongated holes 512 are alternately arranged with the second spring tangs 32 in the transverse direction. A plurality of round holes 513 are formed in two opposite side regions of the first shielding plate 30, of which some is for extension of the aligned post (not labeled) of the corresponding contact module (illustrated later), and some is for filling the insulative material during the overmolding process. The second shielding plate 40 has the similar corresponding structures and aligned with those in the first shielding plate 30 in the vertical direction.

During manufacturing, the first contacts 20*a* is integrally formed within a first contact module 13 via an insert-molding process, and the second contacts 20*b* is integrally formed within a second contact module 14. The first contact module 13 and the second contact module 14 commonly sandwich the stacked first shielding plate 30 and second shielding plate 40 and with the first metallic shell 15 and the second metallic shell 16 on two opposite surfaces to commonly form the complete connector 100 via an overmolding process wherein the first metallic shell 15 and the second metallic shell 16 are exposed upon the corresponding mating surfaces 121 behind the corresponding contacting sections 21. Notably, the insulative portion (not labeled) of the first contact module 13 forms a plurality of through holes (not labeled) of which some are for extension of the spring tangs and some are for allowing filling of the insulative material during the over-molding process. Some of the through holes of the first contact module 13 are aligned with the holes in the shielding plate 30.

Figure 6:
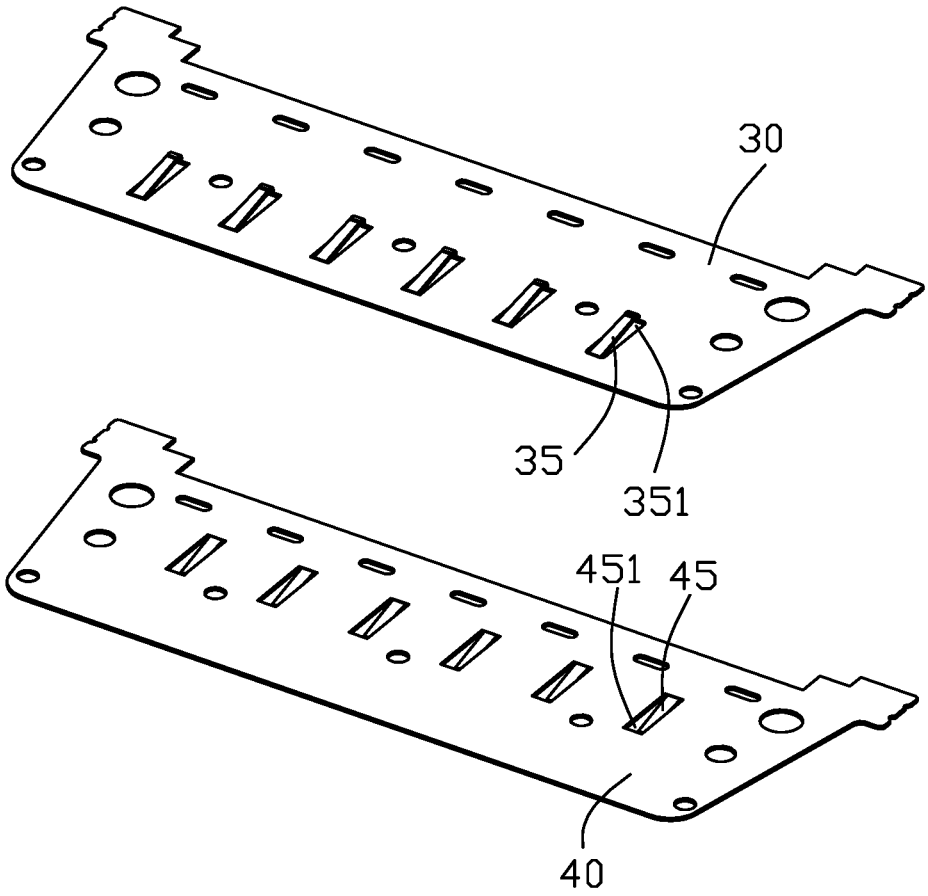
FIG. 6 is an exploded perspective view of the shielding plates of another embodiment for use of the electrical connector of FIG. 4.
Figure 7:
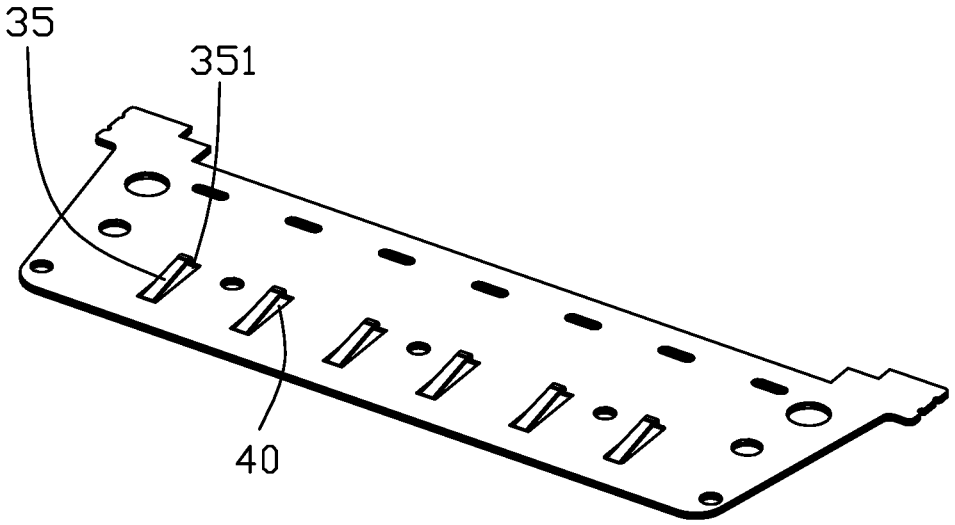
FIG. 7 is an assembled perspective view of the shielding plates of the electrical connector of FIG. 6.

FIGS. 6-7 shows the second embodiment similar to the first embodiment except the first shielding plate 30 only includes the first spring tangs 35 and the second shielding plate 40 only includes the second spring tangs 45. Notably, the second shielding plate 40 may cover the openings derived from the first spring tangs 35, and the first shielding plate 30 may cover the openings derived from the second spring tangs 45. Understandably, such covering effect can not be achieved by the single layer shielding plate structure.

In brief, the double-layer shielding plate structure, i.e., the stacked paired shielding plates, may either provide the double-contact point effect to the same grounding contact or cover the openings derived from the spring tang of the other layer. Understandably, if the contact has the sufficient length, it is also possible to perform the double-contact point effect and opening covering both simultaneously. In addition, the first shielding plate and the second shielding plate are arranged to be same with each other in an opposite mirror image manner so as to form a symmetrical force application in the whole connector structure, compared with the single layer shielding plate structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a first contact module with a plurality of first contact retained therein in a transverse direction via an insert-molding process and including a plurality of first grounding contacts thereof;

a second contact module with a plurality of second contacts retained therein in the transverse direction via another insert-molding process and having a plurality of second grounding contacts thereof; and opposite metallic first and second shielding plates stacked with each other and commonly sandwiched between the first contact module and the second contact module in a vertical direction perpendicular to the transverse direction; wherein the first shielding plate forms a plurality of first spring tangs in one row and a plurality of second sprint tangs in another row spaced from the first springs in a front-to-back direction perpendicular to the transverse direction and the vertical direction; wherein the first spring tangs and the second spring tangs are paired, and the paired first sprint tang and second spring tang commonly contact a same first grounding contact of the first contacts.

2. The electrical connector as claimed in claim 1, wherein said second shielding plate forms a plurality of first spring tangs in one row and a plurality of second sprint tangs in another row spaced from the first spring tangs thereof in the front-to-back direction; wherein the first spring tangs and the second spring tangs of the second shielding plate are paired, and the paired first spring tang and second spring tang of the second shielding plate commonly contact a same second grounding contact of the second contacts.

3. The electrical connector as claimed in claim 2, wherein the first spring tangs of the first shielding plate and the first spring tangs of the second shielding plate are paired and aligned with each other in the vertical direction.

4. The electrical connector as claimed in claim 3, wherein said first shielding plate and said second shielding plate are same with each other in an opposite mirror image manner.

5. The electrical connector as claimed in claim 1, further including an insulative housing with a base and a mating tongue extending forwardly from the base in the front-to-back direction, wherein each of the first contacts has a front contacting section exposed upon a mating surface on the mating tongue, a rear connecting section exposed out of the base, and an intermediate section therebetween.

6. The electrical connector as claimed in claim 5, wherein the first spring tang contacts an undersurface of the contacting section of the corresponding first grounding contact, and the second spring tang contacts a rear portion of the connecting section.

7. The electrical connector as claimed in claim 1, wherein the first spring tang and the second spring tang extend away from each other in the front-to-back direction.

8. The electrical connector as claimed in claim 1, wherein the first shielding plate has a plurality of through hole aligned with those formed in the second shielding plate in the vertical direction.

9. The electrical connector as claimed in claim 1, where the first shielding plate forms a plurality of through holes aligned with those formed in the first contact module in the vertical direction.

10. The electrical connector as claimed in claim 1, wherein the first contact module forms a plurality of holes to receive the corresponding first spring tangs, respectively.

11. An electrical connector comprising:

a first contact module with a plurality of first contact retained therein in a transverse direction via an insert-molding process and including a plurality of first grounding contacts thereof;

a second contact module with a plurality of second contacts retained therein in the transverse direction via another insert-molding process and having a plurality of second grounding contacts thereof; and opposite metallic first and second shielding plates stacked with each other and commonly sandwiched between the first contact module and the second contact module in a vertical direction perpendicular to the transverse direction; wherein the first shielding plate forms a plurality of first spring tangs in one row and extending toward and contacting the corresponding first grounding contact, and the second shielding plate forms a plurality of first spring tangs in another row and extending toward and contacting the corresponding second grounding contact.

12. The electrical connector as claimed in claim 11, wherein the first sprint tangs of the first shielding plate and the first spring tangs of the second shielding plate are paired and aligned with each other in the vertical direction.

13. The electrical connector as claimed in claim 12, wherein the first shielding plate and the second shielding plate are same with each other but in an opposite mirror image manner.

14. The electrical connector as claimed in claim 11, wherein each of the first contacts includes a front contacting section, a rear connecting section and an intermediate section therebetween in a front-to-back direction perpendicular to both the transverse direction and the vertical direction, and the first spring tang contacts an undersurface of the contacting section of the corresponding first grounding contact.

15. The electrical connector as claimed in claim 14, wherein the first contact module forms a plurality of holes to receive the corresponding first spring tangs, respectively.

16. The electrical connector as claimed in claim 11, wherein the first shielding plate forms a plurality of holes aligned with those formed in the first contact module in the vertical direction.

17. The electrical connector as claimed in claim 11, wherein the first shielding plate forms a plurality of holes aligned with those formed in the second shielding plate in the vertical direction.

18. An electrical connector comprising:

an insulative housing having a base and a mating tongue forwardly extending from the base;

a plurality of first contacts arranged in a first row along a transverse direction and commonly retained in the housing;

a plurality of second contacts arranged in a second row along said transverse direction and commonly retaining in the housing;

opposite metallic first and second shielding plates stacked with each other and commonly sandwiched between the first contact module and the second contact module in a vertical direction perpendicular to the transverse direction; wherein the first shielding plate forms a plurality of first spring tangs in one row and extending toward and contacting the corresponding first grounding contact, and the second shielding plate forms a plurality of first spring tangs in another row and extending toward and contacting the corresponding second grounding contact.

19. The electrical connector as claimed in claim 18, wherein the first sprint tangs of the first shielding plate and the first spring tangs of the second shielding plate are paired and aligned with each other in the vertical direction.

20. The electrical connector as claimed in claim 19, wherein the first shielding plate and the second shielding plate are same with each other but in an opposite mirror image manner.

* * * * *